US008358796B2

(12) United States Patent
Puder

(10) Patent No.: US 8,358,796 B2
(45) Date of Patent: Jan. 22, 2013

(54) METHOD AND ACOUSTIC SIGNAL PROCESSING SYSTEM FOR BINAURAL NOISE REDUCTION

(75) Inventor: Henning Puder, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 386 days.

(21) Appl. No.: 12/729,437

(22) Filed: Mar. 23, 2010

(65) Prior Publication Data

US 2010/0246850 A1 Sep. 30, 2010

(30) Foreign Application Priority Data

Mar. 24, 2009 (EP) ..... 09004196

(51) Int. Cl.
*H04R 25/00* (2006.01)

(52) U.S. Cl. ..... 381/317; 381/313; 381/94.1; 381/94.7; 704/226; 704/233

(58) Field of Classification Search ..... 381/91–92, 381/94.1, 94.7, 313, 317; 704/226, 233
See application file for complete search history.

(56) References Cited

U.S. PATENT DOCUMENTS

| | | | | |
|---|---|---|---|---|
| 7,099,821 | B2 * | 8/2006 | Visser et al. | 704/226 |
| 7,295,972 | B2 * | 11/2007 | Choi | 704/226 |
| 2006/0120535 | A1 * | 6/2006 | Puder | 381/26 |
| 2007/0021958 | A1 | 1/2007 | Visser et al. | |
| 2010/0183178 | A1 * | 7/2010 | Kellermann et al. | 381/317 |
| 2010/0185178 | A1 * | 7/2010 | Sharp et al. | 604/506 |
| 2010/0232621 | A1 * | 9/2010 | Aichner et al. | 381/94.1 |
| 2011/0103626 | A1 * | 5/2011 | Bisgaard et al. | 381/313 |

FOREIGN PATENT DOCUMENTS

WO WO 2007/128825 A1 11/2007

OTHER PUBLICATIONS

Erik Visser, Te -Won Lee; "Speech Enhancement using blind source separation and two-channel energy based speaker detection"; 2003; Institute for Neural Computation University of California, San Diego, La Jolla, CA; pp. I-884 to I-887.

Yu Takahashi, Keiichi Osako, Hiroshi Saruwatari, Kiyohiro Shikano; "Blind source extraction for hands-free speech recognition based on wiener filtering and ICA-based noise estimation"; Nara Institute of Science and Technology, Nara 630-0192, Japan, 2008, IEEE; pp. 164-167.

* cited by examiner

*Primary Examiner* — Disler Paul

(57) ABSTRACT

A method and an acoustic signal processing system for noise reduction of a binaural microphone signal are proposed. A source signal and two interfering signals input to a left and a right microphone of a binaural microphone system respectively. A left and a right microphone signal is filtered by a Wiener filter to obtain binaural output signals of the source signal. The Wiener filter is calculated as $$H_W(\Omega) = 1 - \frac{S_{y1,y1}(\Omega)}{S_{v1,v1}(\Omega) + S_{v2,v2}(\Omega)},$$

wherein $S_{y1,y1}(\Omega)$ is the auto power spectral density of the sum of the interfering signals contained in the left and right microphone signal, $S_{v1,v1}(\Omega)$ is the auto power spectral density of the filtered left microphone signal and $S_{v2,v2}$ is the auto power spectral density of the filtered right microphone signal. The method provides the advantage of an improved binaural noise reduction compared to the state of the art with small or less signal distortion.

8 Claims, 4 Drawing Sheets

METHOD AND ACOUSTIC SIGNAL PROCESSING SYSTEM FOR BINAURAL NOISE REDUCTION

CROSS REFERENCE TO RELATED APPLICATIONS

This application claims priority of European application No. 09004196 filed Mar. 24, 2009, which is incorporated by reference herein in its entirety.

FIELD OF THE INVENTION

The present invention relates to a method and an Acoustic Signal Processing System for noise reduction of a binaural microphone signal with one source signal and several interfering signals as input signals to a left and a right microphone of a binaural microphone system. Specifically, the present invention relates to hearing aids employing such methods and devices.

BACKGROUND OF THE INVENTION

In signal enhancement tasks, adaptive Wiener Filtering is often used to suppress the background noise and interfering sources. For the required interference and noise estimates, several approaches are proposed usually exploiting VAD (Voice Activity Detection), and beam-forming, which uses a microphone array with a known geometry. The drawback of VAD is that the voice-pause cannot be robustly detected, especially in the multi-speaker environment. The beamformer does not rely on the VAD, nevertheless, it needs a priori information about the source positions. As an alternative method, Blind Source Separation (BSS) was proposed to be used in speech enhancement which overcomes the drawbacks mentioned and drastically reduces the number of microphones. However, the limitation of BSS is that the number of point sources cannot be larger than the number of microphones, or else BSS is not capable to separate the sources.

In US 2006/0120535 A1 a method and an acoustic system is disclosed which generate a stereo signal for each for multiple separate sources. A blind source separation of at lest two microphone signals is conducted to acquire BSS filters. Each of the microphone signals is filtered with its own filter transfer function that is the quotient of a power density spectral portion of the respective sound source and the overall power density spectrum of the respective microphone signal, such that the two stereo signals are obtained for each microphone signal.

SUMMARY OF THE INVENTION

It is the object of the present invention to provide a method and an acoustic signal processing system for improving interference estimation in binaural Wiener Filtering in order to effectively suppress background noise and interfering sources.

According to the present invention the above objective is fulfilled by a method of claim 1 and an acoustic processing system of claim 4 for noise reduction of a binaural microphone signal.

The invention claims a method for noise reduction of a binaural microphone signal with one source signal as input signal to a left and a right microphone of a binaural microphone system and at least a first interfering signal as input signal to the left microphone and at least a second interfering signal as input signal to the right microphone, comprising the step of:

filtering a left and a right microphone signal by a Wiener filter to obtain binaural output signals of the source signal, where said Wiener filter is calculated as $$H_W(\Omega) = 1 - \frac{S_{y1,y1}(\Omega)}{S_{v1,v1}(\Omega) + S_{v2,v2}(\Omega)},$$

where $H_W(\Omega)$ is said Wiener filter, $S_{y1,y1}(\Omega)$ is the auto power spectral density of the sum of the interfering signals contained in the left and right microphone signal, $S_{v1,v1}(\Omega)$ is the auto power spectral density of the filtered left microphone signal $v_1$ and $S_{v2,v2}$ is the auto power spectral density of the filtered right microphone signal $v_2$.

The invention provides the advantage of an improved binaural noise reduction compared to the state of the art with small or less signal distortion.

In a preferred embodiment the sum of the interfering signals can be approximated by an output of an adaptive Blind Source Separation Filtering with the left and right microphone signal as input signals.

Furthermore the filtered left microphone signal and the filtered right microphone signal are generated by filtering with one of the Blind Source Separation Filter constants.

The invention also claims an acoustic Signal Processing System comprising a binaural microphone system with a left and a right microphone and a Wiener filter unit for noise reduction of a binaural microphone signal with one source signal as input signal to said left and a right microphone and at least a first interfering signal as input signal to the left microphone and at least a second interfering signal as input signal to the right microphone, whereas:

the algorithm of said Wiener filter unit is calculated as $$H_W(\Omega) = 1 - \frac{S_{y1,y1}(\Omega)}{S_{v1,v1}(\Omega) + S_{v2,v2}(\Omega)},$$

where $S_{y1,y1}(\Omega)$ is the auto power spectral density of the sum of the interfering signals contained in the left and right microphone signal, $S_{v1,v1}(\Omega)$ is the auto power spectral density of the filtered left microphone signal and $S_{v2,v2}(\Omega)$ is the auto power spectral density of the filtered right microphone signal, and the left microphone signal and the right microphone signal are filtered by said Wiener filter unit to obtain binaural output signals of the source signal.

In a further embodiment the acoustic signal processing system can comprise a Blind Source Separation unit, whereas the sum of all the interfering signals contained in the left and right microphone signal is approximated by an output of the Blind Source Separation unit with the left and right microphone signal as input signals.

Furthermore, the filtered left microphone signal and the filtered right microphone signal can be generated by filtering with one of Blind Source Separation Filter constants.

Finally, the left and right microphone can be located in different hearing aids.

BRIEF DESCRIPTION OF THE DRAWINGS

More specialties and benefits of the present invention are explained in more detail by means of schematic drawings showing in.

DETAILED DESCRIPTION OF THE INVENTION

Figure 1:
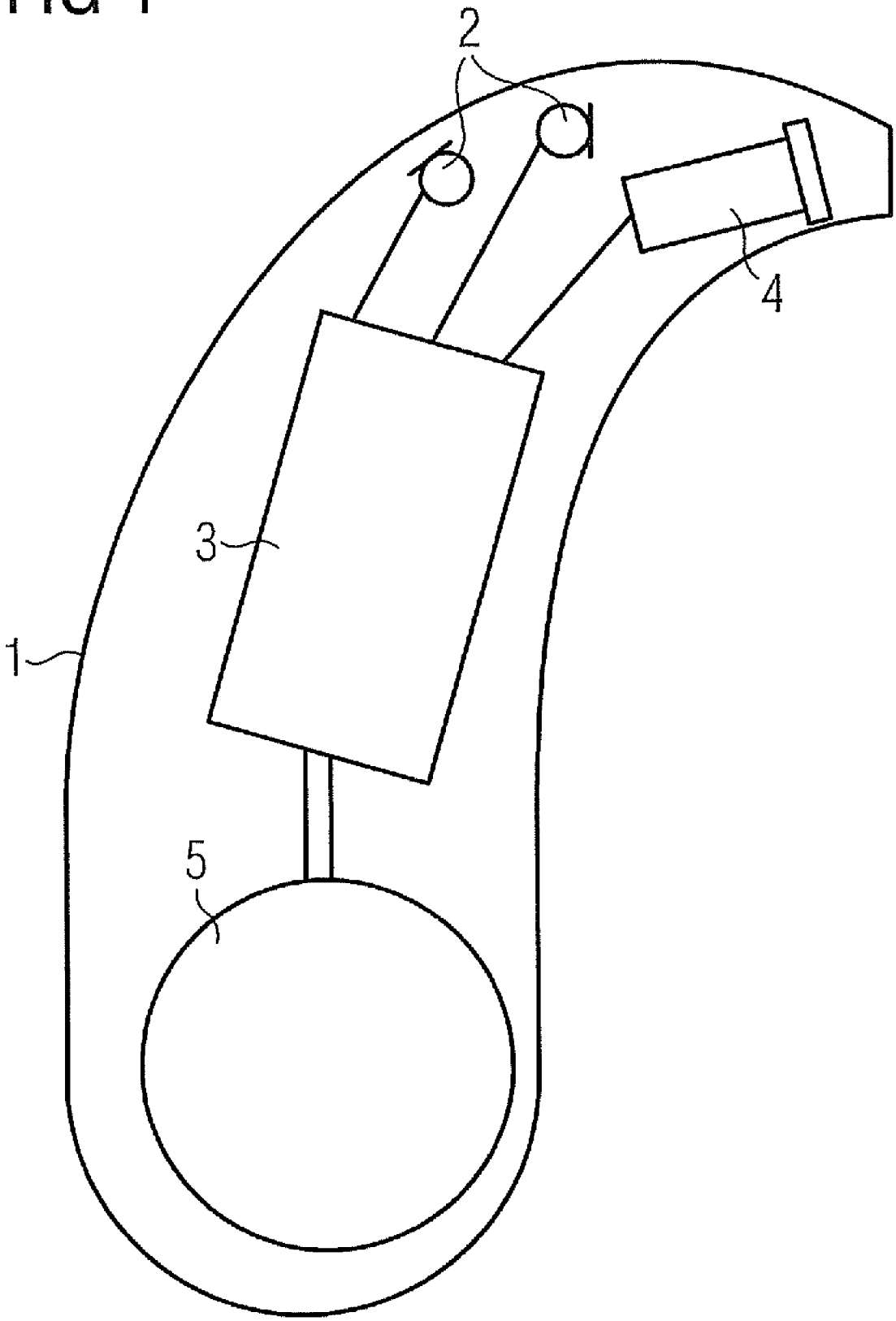
FIG. 1: a hearing aid according to the state of the art.

Since the present application is preferably applicable to hearing aids, such devices shall be briefly introduced in the next two paragraphs together with FIG. 1.

Hearing aids are wearable hearing devices used for supplying hearing impaired persons. In order to comply with the numerous individual needs, different types of hearing aids, like behind-the-ear hearing aids and in-the-ear hearing aids, e.g. concha hearing aids or hearing aids completely in the canal, are provided. The hearing aids listed above as examples are worn at or behind the external ear or within the auditory canal. Furthermore, the market also provides bone conduction hearing aids, implantable or vibrotactile hearing aids. In these cases the affected hearing is stimulated either mechanically or electrically.

In principle, hearing aids have one or more input transducers, an amplifier and an output transducer as essential component. An input transducer usually is an acoustic receiver, e.g. a microphone, and/or an electromagnetic receiver, e.g. an induction coil. The output transducer normally is an electroacoustic transducer like a miniature speaker or an electromechanical transducer like a bone conduction transducer. The amplifier usually is integrated into a signal processing unit. Such principle structure is shown in FIG. 1 for the example of a behind-the-ear hearing aid. One or more microphones 2 for receiving sound from the surroundings are installed in a hearing aid housing 1 for wearing behind the ear. A signal processing unit 3 being also installed in the hearing aid housing 1 processes and amplifies the signals from the microphone. The output signal of the signal processing unit 3 is transmitted to a receiver 4 for outputting an acoustical signal. Optionally, the sound will be transmitted to the ear drum of the hearing aid user via a sound tube fixed with an otoplastic in the auditory canal. The hearing aid and specifically the signal processing unit 3 are supplied with electrical power by a battery 5 also installed in the hearing aid housing 1.

In a preferred embodiment of the invention two hearing aids, one for the left ear and one for the right ear, are used ("binaural supply"). The two hearing aids can communicate with each other in order to exchange microphone data.

If the left and right hearing aids include more than one microphone any preprocessing that combines the microphone signals to a single signal in each hearing aid can use the invention.

Figure 2:
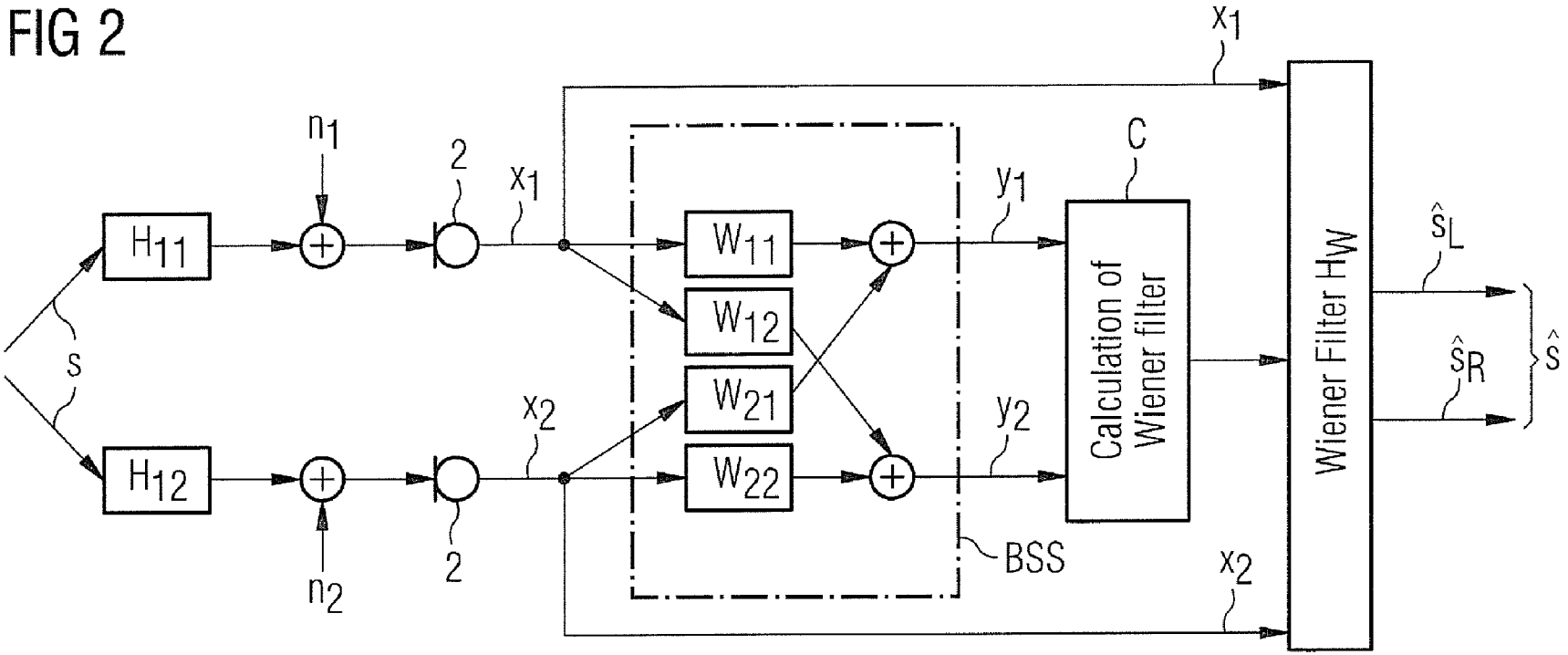
FIG. 2: a block diagram of a principle scenario for binaural noise reduction by BSS Filtering and Wiener Filtering.

FIG. 2 shows the principle scheme which is composed of three major components. In the following the discrete time index k of signals is omitted for simplicity, e.g. x instead of x(k). The first component is the linear Blind Source Separation model in an underdetermined scenario. A source signal s is filtered by a linear input-output system with signal model filters $H_{11}(\Omega)$ and $H_{12}(\Omega)$ and mixed with a first and second interfering signal $n_1$, $n_2$ before they are picked up by two microphones 2, e.g. of a left and a right hearing aid. Ω denotes the frequency argument. The microphones 2 generate a left and a right microphone signal $x_1$, $x_2$. Both signals $x_1$, $x_2$ contain signal and noise portions.

Blind Source Separation BSS as the second component is exploited to estimate the interfering signals $n_1$, $n_2$ by filtering the two microphone signals $x_1$, $x_2$ with adaptive BSS filter constants $W_{11}(\Omega)$, $W_{12}(\Omega)$, $W_{21}(\Omega)$, $W_{22}(\Omega)$. Two estimated interference signals $Y_1(\Omega)$, $Y_2(\Omega)$ are the output of the Blind Source Separation BSS according to:

$$\begin{bmatrix} Y_1(\Omega) \\ Y_2(\Omega) \end{bmatrix} = \begin{bmatrix} W_{11}(\Omega) & W_{12}(\Omega) \\ W_{21}(\Omega) & W_{22}(\Omega \end{bmatrix} \times \begin{bmatrix} X_1(\Omega) \\ X_2(\Omega) \end{bmatrix} \tag{1}$$

Blind Source Separation's major advantage is that it can deal with an underdetermined scenario.

In the third component the estimated interference signals $y_1$, $y_2$ are used to calculate a time-varying Wiener filter $H_W(\Omega)$ by a calculation means C. Finally, the binaural enhanced source signal $\hat{s}=[\hat{s}_L,\hat{s}_R]$ can be obtained by filtering the binaural microphone signals $x_1$, $x_2$ with the calculated Wiener filter $H_W(\Omega)$. Applying the same filter to the signals of both sides binaural cues are perfectly preserved not only for the source signal s but also for residual interfering signals. Especially the application to hearing aids can benefit from this property.

In case separate estimations for the first and second interfering signal $n_1$, $n_2$ are available two separate optimal Wiener Filters $H_{W1}(\Omega)$ and $H_{W2}(\Omega)$ are calculated as:

$$H_{w,1}(\Omega) = 1 - \frac{S_{n1,n1}(\Omega)}{S_{n1,n1}(\Omega) + |H_{11}(\Omega)|^2 S_{s,s}(\Omega)} \tag{2}$$

$$H_{w,2}(\Omega) = 1 - \frac{S_{n2,n2}(\Omega)}{S_{n2,n2}(\Omega) + |H_{12}(\Omega)|^2 S_{s,s}(\Omega)}, \tag{3}$$

where $S_{xy}$ denotes the cross power spectral density (PSD) between signals x and y and $S_{xx}$ denotes the auto power spectral density of signal x.

Assumed, the estimated interference signal $y_1$ contains only interfering signals $n_1$, $n_2$ one common Wiener Filter $H_W(\Omega)$ can be drawn up for both microphone signals $x_1$, $x_2$. The following explanations are based on this assumption.

In post-published EP 090 00 799 the common Wiener Filter $H_W(\Omega)$ is calculated as:

$$H_w(\Omega) = 1 - \frac{S_{y1,y1}(\Omega)}{S_{x1+x2,x1+x2}(\Omega)}. \tag{4}$$

Figure 3:
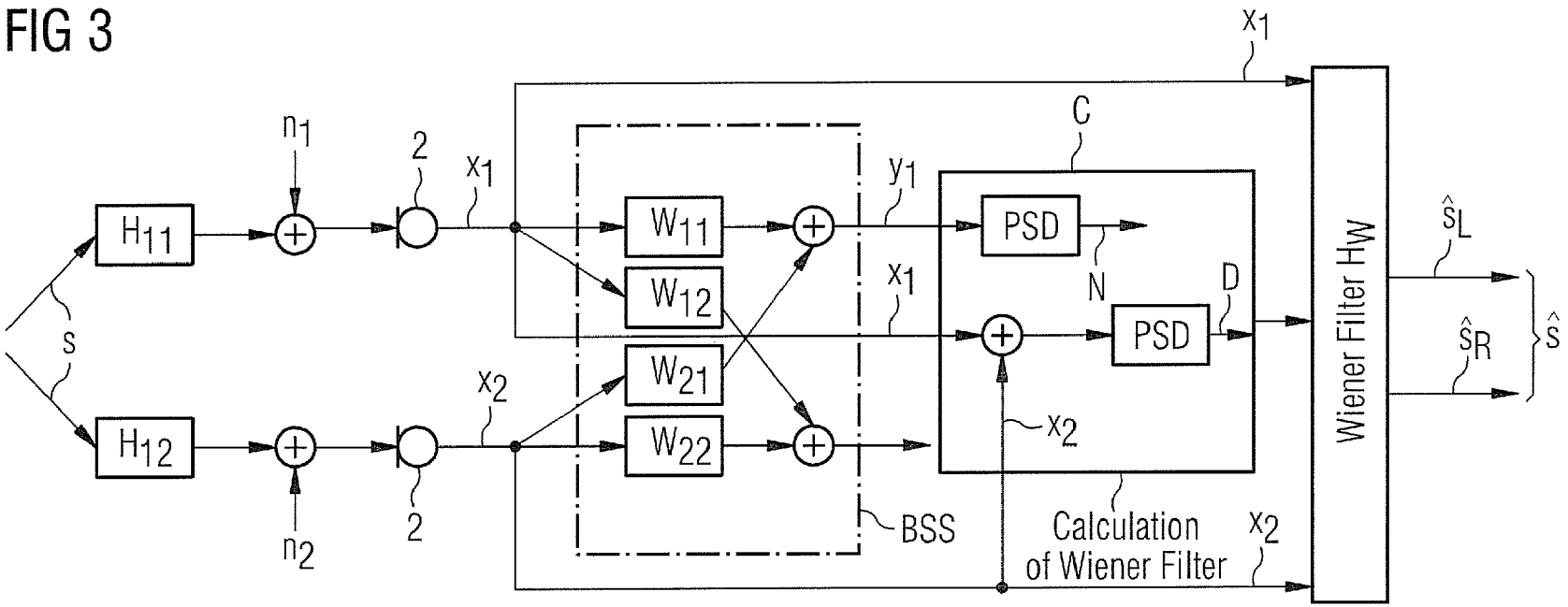
FIG. 3: a block diagram for binaural noise reduction according to post published EP 090 00 799

FIG. 3 is a modification of FIG. 2. The component C "Calculation of Wiener Filter" incorporates the calculation of the nominator term N of equation 4 by auto-PSD of the sum $y_1$ of estimated interference signals. It further incorporates the calculation of the denominator term D of equation 4 by auto-PSD of the sum of the two microphone signals $x_1$, $x_2$.

The approach of EP 090 00 799 is discussed in the following. First of all in equation 4 the BSS filter constants $W_{11}(\Omega)$, $W_{12}(\Omega)$, $W_{21}(\Omega)$, $W_{22}(\Omega)$ and the signal model filters $H_{11}(\Omega)$, $H_{12}(\Omega)$ are introduced:

$$H_w(\Omega) = 1 - \frac{S_{n1,n1}(\Omega)|W_{11}(\Omega)|^2 + S_{n2,n2}(\Omega)|W_{21}(\Omega)|^2 + 2\mathrm{Re}\{S_{n1,n2}(\Omega)W_{11}^*(\Omega)W_{21}(\Omega)\}}{S_{n1,n1}(\Omega) + S_{n2,n2}(\Omega) + 2\mathrm{Re}\{S_{n1,n2}(\Omega)\} + S_{s,s}(\Omega)|H_{11}(\Omega) + H_{12}(\Omega)|^2}. \quad (5)$$

Without reverberant sound ($W_{11}(\Omega)=W_{21}(\Omega)=1$) equation 5 is read as:

$$H_w(\Omega) = 1 - \frac{S_{n1,n1}(\Omega) + S_{n2,n2}(\Omega) + 2\mathrm{Re}\{S_{n1,n2}(\Omega)\}}{S_{n1,n1}(\Omega) + S_{n2,n2}(\Omega) + 2\mathrm{Re}\{S_{n1,n2}(\Omega)\} + S_{s,s}(\Omega)|H_{11}(\Omega) + H_{12}(\Omega)|^2}. \quad (6)$$

The noise portions of nominator and denominator of equation 6 are the same. That means they fit perfectly together.

With reverberant sound and uncorrelated interference signals $n_1$, $n_2$ equation 5 is read as:

$$H_w(\Omega) = 1 - \frac{S_{n1,n1}(\Omega)|W_{11}(\Omega)|^2 + S_{n2,n2}(\Omega)|W_{21}(\Omega)|^2}{S_{n1,n1}(\Omega) + S_{n2,n2}(\Omega) + S_{s,s}(\Omega)|H_{11}(\Omega) + H_{12}(\Omega)|^2}. \quad (7)$$

The noise portions of nominator and denominator of equation 7 significantly differ. That means they do not fit together.

With reverberant sound and uncorrelated interference signals $n_1$, $n_2$ but with same power equation 5 is read as:

$$H_w(\Omega) = 1 - \frac{S_{n,n}(\Omega)|W_{11}(\Omega)|^2 + S_{n,n}(\Omega)|W_{21}(\Omega)|^2}{2S_{n,n}(\Omega) + S_{s,s}(\Omega)|H_{11}(\Omega) + H_{12}(\Omega)|^2}. \quad (8)$$

Again, the noise portions of nominator and denominator of equation 8 do not fit together.

With reverberant sound, uncorrelated interference signals $n_1$, $n_2$ with same power and the source signal s coming from the front ($H_{11}(\Omega)=H_{21}(\Omega)=H(\Omega)$) equation 5 is read as:

$$H_w(\Omega) = 1 - \frac{S_{n,n}(\Omega)|W_{11}(\Omega)|^2 + S_{n,n}(\Omega)|W_{21}(\Omega)|^2}{2S_{n,n}(\Omega) + 4S_{s,s}(\Omega)|H(\Omega)|^2}. \quad (9)$$

Again, the noise portions of nominator and denominator of equation 9 do not fit together.

Figure 4:
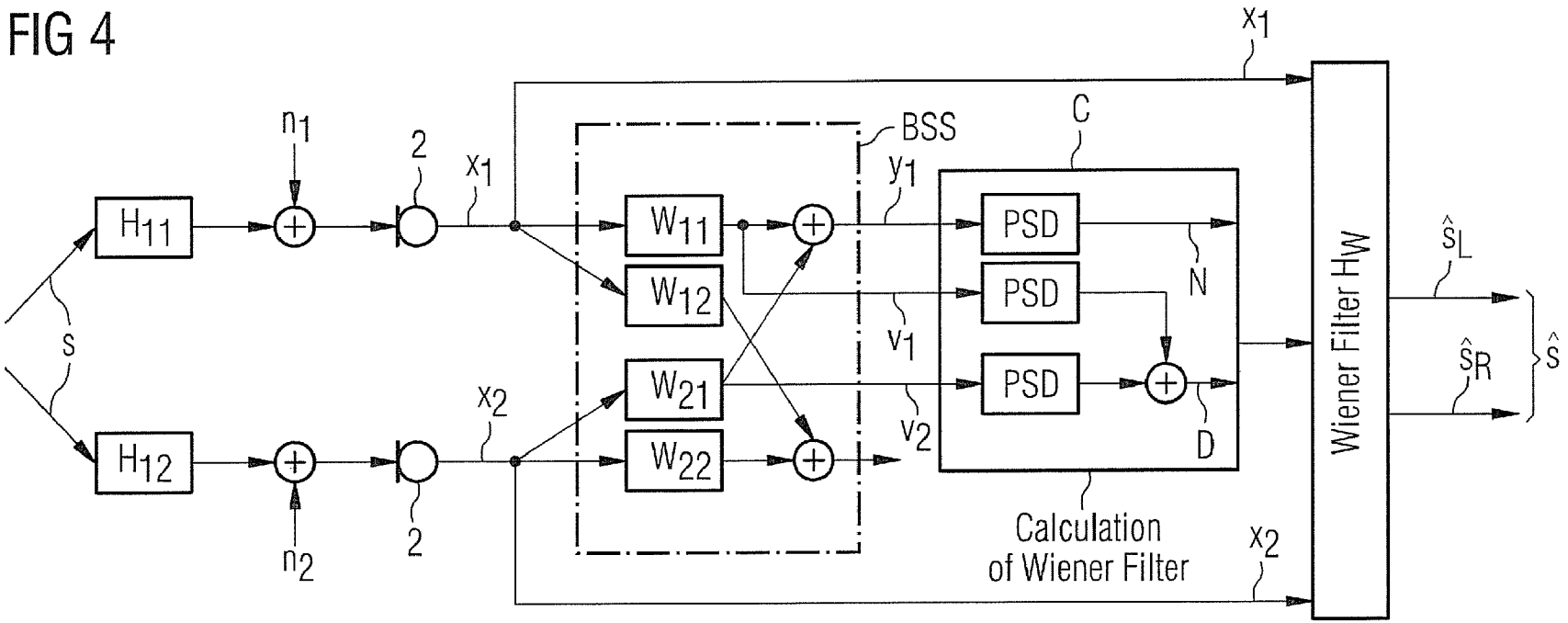
FIG. 4: a block diagram for binaural noise reduction according to the invention.

In contrast to EP 090 00 799 the current invention specifies an approach of Wiener Filter calculation according to FIG. 4. The Wiener Filter $H_W(\Omega)$ is calculated as:

$$H_W(\Omega) = 1 - \frac{S_{y1,y1}(\Omega)}{S_{v1,v1}(\Omega) + S_{v2,v2}(\Omega)}, \quad (10)$$

with intermediate signals $v_1$ and $v_2$ as by $W_{11}(\Omega)$ or $W_{21}(\Omega)$ respectively filtered microphone signals $x_1$, $x_2$ according to:

$$V_1(\Omega)=W_{11}(\Omega)\times X_1(\Omega) \text{ and}$$

$$V_2(\Omega)=W_{21}(\Omega)\times X_2(\Omega). \quad (11)$$

FIG. 4 is a modification of FIG. 2. The component C "Calculation of Wiener Filter" incorporates the calculation of the nominator term N of equation 10 by auto-PSD of the estimated interference signal $y_1$ and the calculation of the denominator term D of equation 11 by the sum of the auto-PSD of the two intermediate signals $v_1$, $v_2$.

The new approach is discussed in the following. First of all in equation 11 the BSS filter constants $W_{11}(\Omega)$, $W_{12}(\Omega)$, $W_{21}(\Omega)$, $W_{22}(\Omega)$ and the signal model filters $H_{11}(\Omega)$, $H_{12}(\Omega)$ are introduced:

$$H_w(\Omega) = 1 - \frac{S_{n1,n1}(\Omega)|W_{11}(\Omega)|^2 + S_{n2,n2}(\Omega)|W_{21}(\Omega)|^2 + 2\mathrm{Re}\{S_{n1,n2}(\Omega)W_{11}^*(\Omega)W_{21}(\Omega)\}}{|W_{11}(\Omega)|^2(S_{n1,n1}(\Omega) + |H_{11}(\Omega)|^2S_{s,s}(\Omega)) + |W_{21}(\Omega)|^2(S_{n2,n2}(\Omega) + |H_{12}(\Omega)|^2S_{s,s}(\Omega))}. \quad (12)$$

Without reverberant sound ($W_{11}(\Omega)=W_{21}(\Omega)=1$) equation 12 is read as:

$$H_w(\Omega) = 1 - \frac{S_{n1,n1}(\Omega) + S_{n2,n2}(\Omega) + 2\mathrm{Re}\{S_{n1,n2}(\Omega)\}}{S_{n1,n1}(\Omega) + S_{n2,n2}(\Omega) + S_{s,s}(\Omega)|H_{11}(\Omega) + H_{12}(\Omega)|^2}. \quad (13)$$

The noise portions of nominator and denominator of equation 13 are different (the noise cross PSD is missing in the nominator). That means the noise portions do not fit together. Since a system without reverberant sound is rather unlikely the mismatch is not very important.

With reverberant sound and uncorrelated interference signals $n_1$, $n_2$ equation 12 is read as:

$$H_w(\Omega) = 1 - \frac{S_{n1,n1}(\Omega)|W_{11}(\Omega)|^2 + S_{n2,n2}(\Omega)|W_{21}(\Omega)|^2}{S_{n1,n1}(\Omega)|W_{11}(\Omega)|^2 + S_{n2,n2}(\Omega)|W_{21}(\Omega)|^2 + S_{s,s}(\Omega)(|W_{11}(\Omega)|^2|H_{11}(\Omega)|^2 + |W_{21}(\Omega)|^2|H_{12}(\Omega)|^2)}. \quad (14)$$

The noise portions of nominator and denominator of equation 14 are the same. That means they fit perfectly together.

With reverberant sound and uncorrelated interference signals $n_1$, $n_2$ but with same power equation 12 is read as:

$$H_w(\Omega) = 1 - \frac{S_{n,n}(\Omega)(|W_{11}(\Omega)|^2 + |W_{21}(\Omega)|^2)}{S_{n,n}(\Omega)(|W_{11}(\Omega)|^2 + |W_{21}(\Omega)|^2) + S_{s,s}(\Omega)(|W_{11}(\Omega)|^2|H_{11}(\Omega)|^2 + |W_{21}(\Omega)|^2|H_{12}(\Omega)|^2)}. \quad (15)$$

Again, the noise portions of nominator and denominator of equation 15 fit together.

With reverberant sound, uncorrelated interference signals $n_1$, $n_2$ with same power and the source signal s coming from the front ($H_{11}(\Omega)=H_{21}(\Omega)=H(\Omega)$) equation 12 is read as:

$$H_w(\Omega) = 1 - \frac{S_{n,n}(\Omega)}{S_{n,n}(\Omega) + S_{s,s}(\Omega)}. \quad (16)$$

Again, the noise portions of nominator and denominator of equation 16 fit together.

The invention claimed is:

1. A method for a noise reduction of a binaural microphone system, comprising:

generating a left microphone signal by inputting a source signal and a first interfering signal to a left microphone of the binaural microphone system;

generating a right microphone signal by inputting the source signal and a second interfering signal to a right microphone of the binaural microphone system;

filtering the left and the right microphone signals by a Wiener filter to obtain binaural output signals of the source signal, wherein the Wiener filter is calculated as:

$$H_W(\Omega) = 1 - \frac{S_{y1,y1}(\Omega)}{S_{v1,v1}(\Omega) + S_{v2,v2}(\Omega)},$$

wherein:

$H_W(\Omega)$ is the Wiener filter, $S_{y1,y1}(\Omega)$ is an auto power spectral density of a sum of the first and the second interfering signals, $S_{v1,v1}(\Omega)$ is an auto power spectral density of a filtered left microphone signal, $S_{v2,v2}(\Omega)$ is an auto power spectral density of a filtered right microphone signal;

inputting the left and the right microphone signals to a Blind Source Separation Filter; and approximating the sum of the first and the second interfering signals by an output of the Blind Source Separation Filter.

2. The method as claimed in claim 1, wherein the filtered left microphone signal is generated by filtering the left microphone signal with a first constant of the Blind Source Separation Filter.

3. The method as claimed in claim 1, wherein the filtered right microphone signal is generated by filtering the right microphone signal with a second constant of the Blind Source Separation Filter.

4. An acoustic signal processing system comprising a binaural microphone system, comprising:

a left microphone with a left microphone signal comprising a source signal and a first interfering signal;

a right microphone with a right microphone signal comprising the source signal and a second interfering signal;

a Wiener filter that reduces a noise of the binaural microphone system, wherein the Wiener filter is calculated as:

$$H_W(\Omega) = 1 - \frac{S_{y1,y1}(\Omega)}{S_{v1,v1}(\Omega) + S_{v2,v2}(\Omega)},$$

wherein:

$H_W(\Omega)$ is the Wiener filter, $S_{y1,y1}(\Omega)$ is an auto power spectral density of a sum of the first and the second interfering signals, $S_{v1,v1}(\Omega)$ is an auto power spectral density of a filtered left microphone signal, and $S_{v2,v2}(\Omega)$ is an auto power spectral density of a filtered right microphone signal; and a Blind Source Separation filter with the left and the right microphone signals as an input signal that approximates the sum of the first and the second interfering signals by an output of the Blind Source Separation filter.

5. The acoustic signal processing system as claimed in claim 4, wherein the filtered left microphone signal is generated by filtering the left microphone signal with a first constant of the Blind Source Separation filter.

6. The acoustic signal processing system as claimed in claim 4, wherein the filtered right microphone signal is generated by filtering the right microphone signal with a second constant of the Blind Source Separation filter.

7. The acoustic signal processing system as claimed in claim 4, wherein the left and the right microphones are located in a hearing aid.

8. The acoustic signal processing system as claimed in claim 4, wherein the Wiener filter is configured to filter the left and the right microphone signals to obtain binaural output signals of the source signal.

* * * * *